US009474928B1

(12) United States Patent
Maresh

(10) Patent No.: US 9,474,928 B1
(45) Date of Patent: Oct. 25, 2016

(54) TREADMILL WITH FOLDING OVERHEAD HANDLEBAR ASSEMBLY

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

(21) Appl. No.: 14/588,901

(22) Filed: Jan. 2, 2015

Related U.S. Application Data

(60) Provisional application No. 61/964,363, filed on Jan. 2, 2014.

(51) Int. Cl.
*A63B 22/02* (2006.01)
*A63B 22/00* (2006.01)
*A63B 71/00* (2006.01)

(52) U.S. Cl.
CPC ..... *A63B 22/02* (2013.01); *A63B 22/0235* (2013.01)

(58) Field of Classification Search
CPC .. A63B 22/00; A63B 22/02; A63B 22/0235; A63B 22/0242; A63B 22/0207; A63B 22/0214; A63B 22/0221; A63B 22/0228
USPC ..... 482/51, 54
See application file for complete search history.

(56) References Cited

U.S. PATENT DOCUMENTS 4,114,873 A * 9/1978 Jones ..... A63B 69/0022 482/139
6,132,343 A * 10/2000 Eze ..... A63B 21/0615 482/97
6,494,814 B1 * 12/2002 Wang ..... A63B 22/02 482/51
6,676,569 B1 * 1/2004 Radow ..... A63B 22/0235 482/4
6,719,665 B1 * 4/2004 Lai ..... A63B 23/03575 482/52
7,179,205 B2 * 2/2007 Schmidt ..... A63B 21/0058 482/51
7,291,096 B2 * 11/2007 Ho ..... A63B 21/0084 482/53
7,494,450 B2 * 2/2009 Solomon ..... A61H 1/0229 482/51
7,794,361 B2 * 9/2010 Wang ..... A63B 21/15 482/51
7,878,950 B1 * 2/2011 Bastian ..... A63B 22/0235 482/139
7,951,048 B1 * 5/2011 Hsiung ..... A63B 22/001 482/52
2004/0214693 A1 * 10/2004 Piaget ..... A63B 22/025 482/52
2006/0293153 A1 * 12/2006 Porth ..... A63B 21/4047 482/52
2007/0015634 A1 * 1/2007 Ho ..... A63B 21/0084 482/54
2008/0176717 A1 * 7/2008 Wang ..... A63B 22/0214 482/54
2009/0111666 A1 * 4/2009 Wang ..... A63B 22/0235 482/54
2009/0253559 A1 * 10/2009 Maresh ..... A63B 23/1209 482/93
2010/0144496 A1 * 6/2010 Schmidt ..... A63B 21/012 482/70
2011/0082011 A1 * 4/2011 Ellis ..... A63B 21/0615 482/54
2011/0281692 A1 * 11/2011 Maresh ..... A63B 23/1209 482/54
2014/0066261 A1 * 3/2014 Wang ..... A63B 22/0064 482/52

* cited by examiner

*Primary Examiner* — Stephen Crow
*Assistant Examiner* — Garrett Atkinson
(74) *Attorney, Agent, or Firm* — Nick A Nichols, Jr.

(57) ABSTRACT

A treadmill exercise machine may include a frame having a base and upright supports extending upward from at a forward end of the base. Horizontal arms connected proximate the upper ends of the supports may extend generally toward the rear end of the base. A handlebar assembly may be rotatably connected proximate the distal ends of the arms. The handlebar assembly may be moved from a non-deployed position to an upright locked position accessible to a user to grasp and pull down on an overhead hand bar of the handlebar assembly to reduce the weight load transmitted to the user's lower body.

2 Claims, 2 Drawing Sheets

TREADMILL WITH FOLDING OVERHEAD HANDLEBAR ASSEMBLY

CROSS-REFERENCE TO RELATED APPLICATION

This application claims the benefit of U.S. Provisional Application Ser. No. 61/961,363, filed Jan. 2, 2014, which application is incorporated herein in its entirety by reference.

BACKGROUND

The present invention relates to exercise apparatus, and more particularly to a treadmill exercise machine including a movable overhead handlebar assembly that may be grasped while running and/or jogging on the treadmill.

Treadmill exercise machines for obtaining aerobic level exercise are well known. Treadmill machines may be by powdered by electric motors or by a user walking, jogging or running on the treadmill endless belt. Treadmill machines are widely used for aerobic conditioning and may be a component of a typical exercise regimen. However, an exerciser may avoid using a treadmill machine when experiencing pain from leg and/or foot injuries, back injuries or back pain from any one of numerous causes. Various exercise machines are available in the prior to exercise specific muscles and/or muscle groups or to perform specific exercises to strengthen a body component, such as the upper torso, or to perfect an athletic motion or technique, such a as proper golf swing. However, there remains a need to for an exercise machine that may be used to maintain one's physical conditioning while injured, particularly when physical mobility may be limited to walking or jogging.

SUMMARY

A treadmill exercise machine may include a frame having a base and upright supports extending upward from at a forward end of the base. Horizontal arms connected proximate the upper ends of the supports may extend generally toward the rear end of the base. A handlebar assembly may be rotatably connected proximate the distal ends of the arms. The handlebar assembly may be moved from a non-deployed position to an upright locked position accessible to a user to grasp and pull down on an overhead hand bar of the handlebar assembly while exercising.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 2:
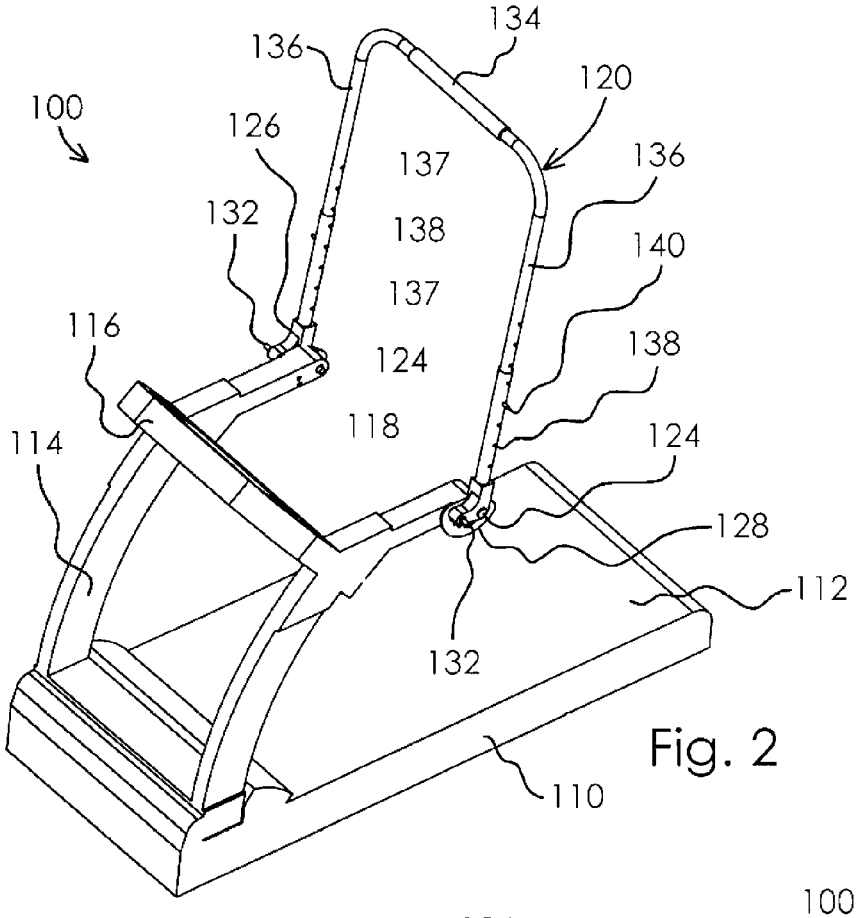
FIG. 2 is a perspective view of a treadmill exercise machine with a handlebar assembly in a deployed position.
Figure 1:
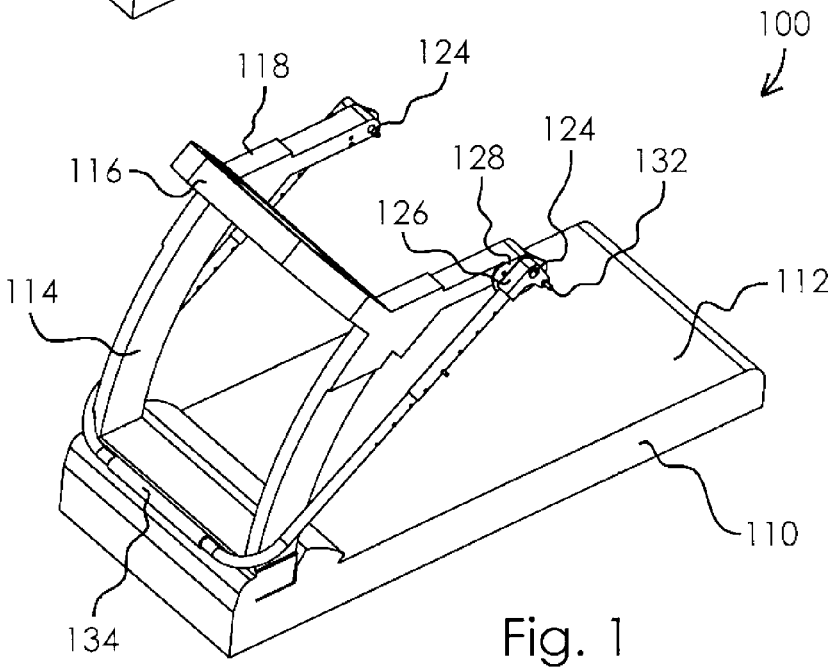
FIG. 1 is a perspective view of a treadmill exercise machine with a handlebar assembly in a parked position.
Figure 4:
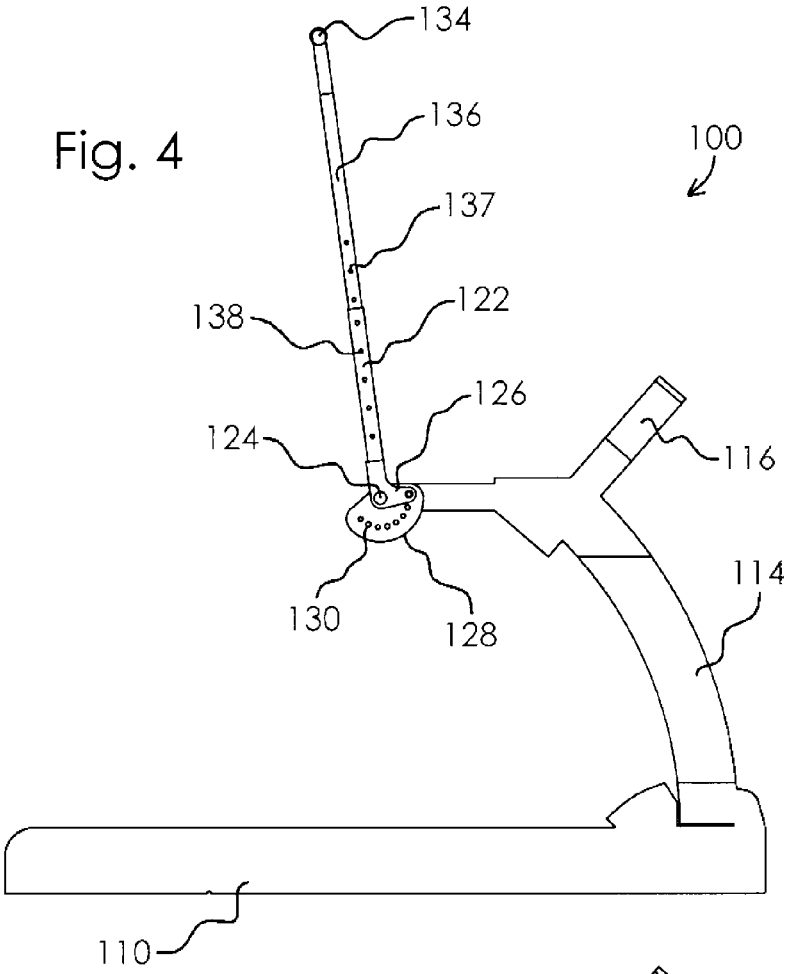
FIG. 4 is a side view of the treadmill exercise machine shown in FIG. 2.
Figure 3:
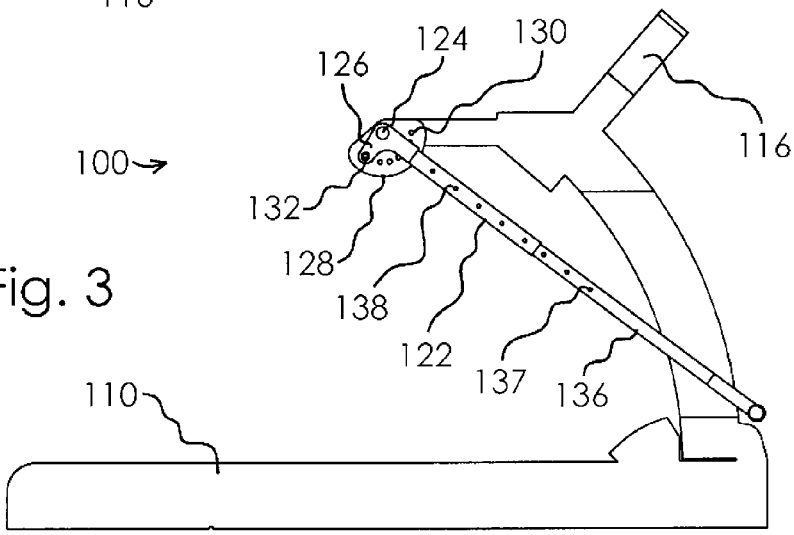
FIG. 3 is a side view of the treadmill exercise machine shown in FIG. 1.

Referring first to FIG. 1, a treadmill exercise machine is generally identified by the reference numeral 100. The treadmill 100 may be of known construction and may include a base 110 supporting an endless belt 112 typically powered by an electric motor. A user may walk, jog and/or run on the endless belt 112. Upright stanchions 114 may extend upward from a front end of the base 110. The stanchions 114 may be spaced from one another and a cross bar connected between the stanchions 114 proximate an upper end thereof may support an interactive display 116 providing a user interface configured to perform a variety of functions, including displaying information to the user, such as available exercise parameters and/or programs and the like. Arms 118 may extend substantially horizontally from the upper ends of the stanchions 114. The arms 118 may be integrally formed with the stanchions 114 or fixedly connected thereto by welding or bolt connectors or other suitable means. The arms 116 may extend generally toward the rear of the treadmill base 110.

A handlebar assembly 120 may be pivotally connected to the arms 118 of the treadmill 100. The handlebar assembly 120 may include sleeve members 122 pivotally attached to a respective arm 118 at pivot shaft 124. An L-shaped or elbow connector 126 may be fixed to the lower ends of the sleeve members 122. The elbow connectors 126 may be integrally formed with the sleeve members 122 or may be separate components welded or otherwise fixedly connected to the sleeve members 122. The elbow connectors 126 may include a first hole extending therethrough proximate the juncture of the orthogonal legs forming the elbow connectors 126. The first hole of the elbow connectors 126 may be aligned with a hole extending through the treadmill arms 118 proximate the distal ends thereof for receiving the shaft 124 through the aligned holes and pivotally connecting the handlebar assembly 120 to the treadmill 100.

The arms 118 may include lobes 128 having a plurality of holes 130 that may be arranged on an arc concentric with the pivot shaft 124. A second hole extending through the elbow connectors 126 proximate the free distal end thereof may be selectively aligned with one of the holes 130 for inserting a pin 132 therethrough to releasably lock the handlebar assembly 120 in an upright deployed position relative to the treadmill arms 118.

The handlebar assembly may further include a U-shaped handlebar comprising a transverse hand grip portion 134 and leg portions 136 extending from the respective ends thereof substantially orthogonal to the hand grip portion 134. The leg portions 136 may include a plurality of holes 137 for alignment with holes 138 linearly spaced along the sleeve members 122. The leg portions 136 may telescope relative to the sleeve members 122 so that the position of the hand grip portion 134 of the handlebar assembly 120 above the movable belt 122 may be adjusted to accommodate for differences in the height of users of the treadmill 100. Upon positioning the hand grip portion 134 to the appropriate height above the belt 112, a retainer pin 140 may be inserted through the holes 138 to lock the hand grip portion 134 of the handlebar assembly 120 to the sleeve members 122. When the handlebar assembly 120 is not deployed for use, the pin 132 may be removed to permit the handlebar assembly to be rotated about the shaft 124 to a storage or parked position generally in front of and below the display 116.

In operation, the handlebar assembly 120 may be rotated to an upright position so that the hand grip portion 134 is located above a user standing on the treadmill belt 112. When a user begins to exercise, he may grasp the hand grip portion 134 of the handlebar assembly 120 and pull downward to reduce the weight bearing load on the user's lower body. The reduction in the weight bearing load is proportional to the weight load transferred to the user's arms while he is pulling down on the handlebar assembly 120. The weight load reduction may not be limited solely to the user's legs and/or feet but may also affect the weight load on a user's spine resulting in a reduction in back pain while the user is exercising.

While pulling down on the handlebar assembly, a user may operate the treadmill 100 at higher speeds and thereby enable higher blood circulation while reducing the weight load on the user's spine and the user's legs and/or feet. The overhead hand grip 134 may provide a user with a longitudinal and lateral sense of the user's position on the endless belt 112 thereby providing an enhanced sense of security operating the treadmill 100, particularly for visually impaired users.

While a preferred embodiment of the invention has been shown and described, other and further embodiments of the invention may be devised without departing from the basic scope thereof, and the scope thereof is determined by the claims which follow.

The invention claimed is:

1. A treadmill exercise apparatus, comprising:

a) a frame having a base configured to rest on a substantially flat surface;

b) a first stanchion and a second stanchion in spaced relationship to one another fixedly secured proximate a forward distal end of said base;

c) a movable surface supported by said base;

d) a first arm and a second arm in spaced relationship to one another fixedly connected proximate an upper end of a respective said first and second stanchion, each said first and second arm extending toward a rearward distal end of said base generally parallel to said base; and e) a substantially U-shaped handlebar rotatably connected to said frame proximate a distal end of said first and second arm, wherein said handlebar includes a first sleeve member and a second sleeve member pivotally connected to a respective said first and second arm, a transverse hand grip portion, and a first leg member and a second leg member extending downwardly from opposite distal ends of said hand grip portion, wherein said first and second leg members are in telescoping relationship with a respective said first and said second sleeve member, and wherein said handlebar is movable between a stored position to a deployed position overhead a user standing on said movable surface.

2. The treadmill apparatus of claim 1 wherein said handlebar is adjustable relative to said movable surface to accommodate users of different heights.

* * * * *